United States Patent [19]

Wilder

[11] 4,249,998

[45] Feb. 10, 1981

[54] APPARATUS AND PROCESS FOR PRODUCING COPPER-BORON CARBIDE COMPOSITE BY ELECTROLYTIC ENTRAPMENT

[75] Inventor: Thomas C. Wilder, Cambridge, Mass.

[73] Assignee: Kennecott Copper Corporation, New York, N.Y.

[21] Appl. No.: 69,526

[22] Filed: Aug. 24, 1979

[51] Int. Cl.[3] ..... C25D 15/00; C25D 17/10; C25D 1/00

[52] U.S. Cl. ..... 204/16; 204/3; 204/12; 204/275

[58] Field of Search ..... 204/12, 3, 4, 16, 27, 204/275

[56] References Cited

U.S. PATENT DOCUMENTS

| | | | |
|---|---|---|---|
| 779,639 | 1/1905 | Case | 204/16 |
| 3,061,525 | 10/1962 | Grazen | 204/16 |
| 3,537,960 | 11/1970 | Esola | 204/16 |

FOREIGN PATENT DOCUMENTS

| | | | |
|---|---|---|---|
| 651826 | 11/1962 | Canada | 204/16 |
| 128448 | 12/1900 | Fed. Rep. of Germany | 204/16 |

*Primary Examiner*—T. M. Tufariello

*Attorney, Agent, or Firm*—John L. Sniado; Anthony M. Lorusso

[57] ABSTRACT

A vertical electrolytic cell for producing a composite layer of boron carbide-filled copper by codeposition of copper and boron carbide particles. A metal substrate serving as a cathode is positioned below a copper anode in an electrolyte containing copper ions. Boron carbide particles are introduced beneath the copper anode, uniformly distributed in the electrolyte and allowed to settle onto the substrate surface while electroplating so that the particles become entrapped in a growing copper matrix. The preferred apparatus includes a plurality of stirrers. One feature of the preferred procedure is to introduce the total volume of boron carbide particles by adding a little at a time, shutting off the stirrers and plating through a settling layer of carbide particles before adding the next batch of particles.

19 Claims, 7 Drawing Figures

APPARATUS AND PROCESS FOR PRODUCING COPPER-BORON CARBIDE COMPOSITE BY ELECTROLYTIC ENTRAPMENT

BACKGROUND OF THE INVENTION

This invention relates generally to apparatus and processes for manufacturing nuclear radiation shields containing boron carbide ($B_4C$), and more particularly to methods by which plates containing boron carbide particles embedded in a copper matrix can be economically manufactured. The primary use for such shield structures is in the fabrication of containers designed for storage, disposal or transportation of nuclear waste materials and other radioactive substances. One of the known types of containers for nuclear waste materials comprises a plurality of rectangular solid boxes about 9×9"×51. The 2-5 mm thick walls made of copper-boron carbide composites contain 20-50% boron carbide by weight. The boxes are embedded in alumunium which is poured (molten) around them and allowed to cool forming a cellular structure.

Boron carbide is the filler of choice because of its high capture cross-section for neutrons. However, absorption of neutrons by boron carbide produces heat. Copper is chosen for the matrix in which the boron carbide particles reside because copper's high specific heat enables it to dissipate a large amount of heat with relatively low temperature rise. Aluminum, in comparison, has a lower melting point and cannot be used alone because of its greater potential for melting.

The ideal boron carbide-filled copper plate material for use in fabricating these and other types of containers would be a substantially pure voidless matrix of copper metal tightly bonded to a uniformly dispersed boron carbide phase consisting of boron carbide particles arranged within the copper matrix such that no straight line passing through the plate fails to impinge upon a carbide particle. If there is too little copper, a product with voids and diminished structural integrity results. With too much copper the boron carbide particles are too sparsely distributed.

The different properties of boron carbide and copper present problems in fabricating boron carbide-filled copper. One process for manufacturing composite plates involving several separate procedures is described in copending U.S. Patent Application Ser. No. 901,843 entitled "Copper-Boron Carbide Composite and Method for Its Production", filed May 1, 1978, by C. C. Wang and assigned to the assignee of the present application. In one embodiment of the process, a film of electroless copper is bonded to the boron carbide. Next a relatively thick electrodeposited copper layer is applied to the film. Finally, the copper encapsulated particles are thermo-mechanically consolidated to produce shield structures by hot rolling or hot pressing, with or without sintering, with a copper to boron weight ratio of 0.3-4.0, typically 0.33.

Boron carbide is commercially available in various particle sizes, for example, from the Carborundum Company of Niagara Falls, N.Y. The electrical resistivity of this material is on the order of $10^4$ to $10^8$ microohms per centimeter. Electrodeposition does not usually lend itself to coating nonconductive materials.

SUMMARY OF THE INVENTION

The general object of the invention is to improve the fabrication of boron carbide-filled copper sheet materials for nuclear waste containers and the like.

The invention provides an apparatus and procedure for codeposition of nonconductive boron carbide particles and copper on a conductive substrate so as to build up a composite layer of boron carbide filled copper. It has been discovered that a uniform layer of nonconductive boron carbide particles can be electrolytically entrapped in a copper matrix by introducing the particles into a vertical electrolytic cell having a flat conductive substrate for the cathode and creating sufficient turbulence in the electrolyte to uniformly distribute and suspend the particles in the electrolyte and then allowing the particles to settle upon the surface of the substrate while electroplating copper onto the substrate so as to surround the particles as they settle with a growing layer of copper.

The apparatus includes a vertical cell having a copper anode with an opening through which the boron carbide particles are introduced into the electrolyte. Propeller type stirrers or equivalent agitators are mounted beneath the anode to agitate the electrolyte to distribute the boron carbide particles. A flat conductive substrate is located on the floor of the cell which is preferably surrounded by a ledge or other irregularity over which the composite builds up to form interfitting edges on the composite layer. The boron carbide particles are added a little at a time, stirred up in the electrolyte and allowed to settle while electroplating. The steps are repeated as the composite layer is gradually built up to the desired depth, following which a finish coat of copper is applied.

Figure 1:
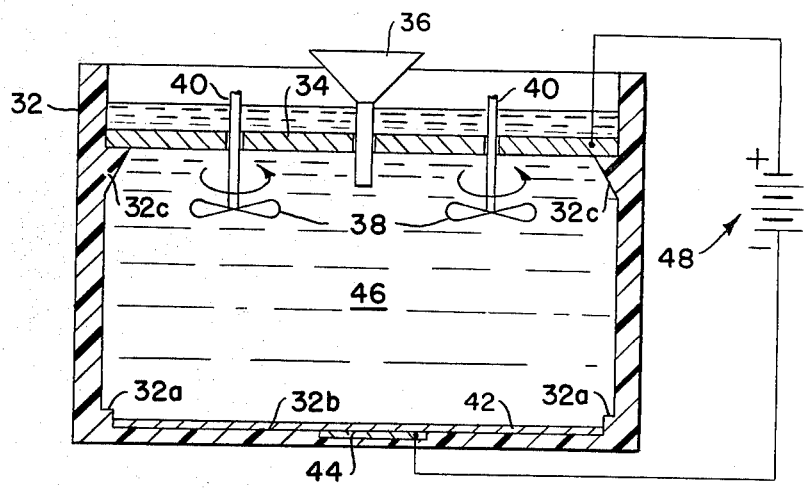
FIG. 1 is a schematic sectional drawing of an embodiment of the vertical electroplating cell according to the invention.

FIGS. *2a–2d* are schematic fragmentary sectional views showing successive stages in the electrodeposition process within the cell of FIG. 1.

Figure 3:
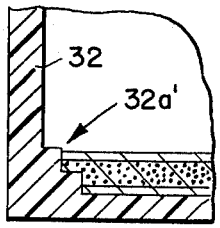

FIG. 3 is a schematic fragmentary sectional view illustrating another embodiment of the cell of FIG. 1.

Figure 4:
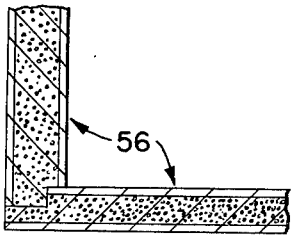

FIG. 4 is a schematic fragmentary sectional view of a joint between two plates produced by the cell of FIG. 1.

DETAILED DESCRIPTION

An electrolytic entrapment technique has been discovered that can be used to intimately coat and bond the boron carbide particles together in a copper matrix even though the carbide particles themselves are almost wholly nonconductive. Improved apparatus for carrying out the electroplating process is shown in FIG. 1. This apparatus is disclosed along with several related manufacturing processes in copending applications Ser. Nos. 069,263 and 069,525 by C. C. Wang filed on the same day as the present application, assigned to the assignee of the present application and incorporated herein by reference in their entirety. The present application is directed specifically to the embodiment illustrated herein and equivalents thereof.

In FIG. 1 an open box-shaped, vertical electrolytic cell 32 is made of a polyacrylic ester, such as that sold under the trademark LUCITE, or another chemically nonreacting electrically nonconductive material. The cell has a step or ledge 32*a* surrounding the floor 32*b*, which, in combination with the ledge 32*a*, defines the form or bed in which the electrodeposited mass is accumulated. The ledge 32*a* preferably has a square cross-section. The side walls of the cell 32 include integral supports 32*c* for a metallic anode 34 which is preferably a phos-deoxidized, apertured copper plate approximately coextensive with the horizontal cross-section of the cell. The anode 34 is fitted with a built-in funnel 36 which is received through an opening in the anode 34 approximately in the center of the cell. Distributed around the funnel 36 are a plurality of stirrers 38 fixed to the ends of respective rotatable shafts 40 extending in parallel through corresponding openings in the anode 34. Each of the stirrer shafts 40 may be coupled to a drive mechanism such as an electric motor. The cell is furnished initially with a removable metal substrate 42, sized to fit the bottom surface 32*b* of the cell, in electrical contact with the cathode contact 44 mounted in the bottom surface 32*b*. The substrate 42 may be stainless steel or copper or another metallic sheet material, preferably, a thin foil or mesh of copper or a sheet up to 1/16 inch in thickness. If structural strength is desired a larger plate can be used for the substrate 42. The entire cell 32 is filled to a level above the anode 34 with a conventional copper electrolyte solution 46 containing copper ions, for example, an aqueous solution of copper sulphate and sulfuric acid. The anode 34 is connected to the "positive" terminal of a battery or other source of direct current 48 and the cathode contact 44 is connected to the "negative" terminal of the source 48.

Figure 2A:
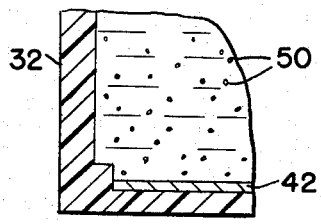
Figure 2B:
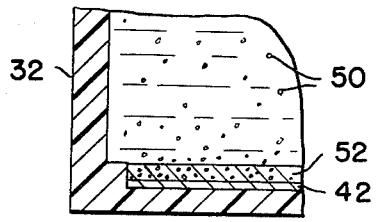
Figure 2C:
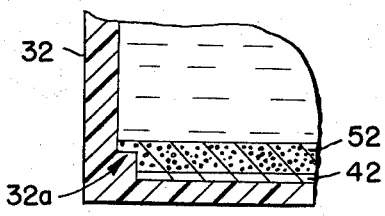
Figure 2D:
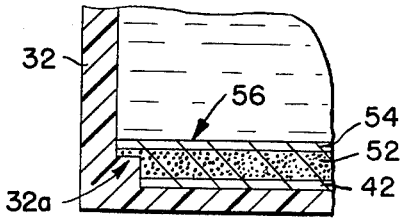

The technique preferably includes two phases of operation: first, the introduction of the unprecoated, electrically nonconductive boron carbide particles 50 (e.g., grit size #50) through the funnel 36 while agitating the electrolyte by means of the stirrers 38 and while electroplating an initial film of pure copper, and, secondly, ceasing agitation of the electrolyte when the particles are uniformly suspended therein and allowing the particles to settle onto the electroplating surface so that the particles become entrapped in the copper plating. The uniform suspension phase is illustrated in FIG. 2*a*. When the stirrers 38 are stopped the particles settle onto the surface while electroplating proceeds. As the copper level rises, the particles 50 become entrapped in the growing composite layer 52 as shown in FIG. 2*b*. The composite layer gradually builds up to a point (FIG. 2*c*) where it overlaps the ledge 32*a* of the cell so as to form a reversible interfitting stepped edge on the resulting composite plate. After the carbide is incorporated in the composite layer 52, a finish coat 54 of pure copper can be applied by continuing the electroplating at higher current density, if desired, as shown in FIG. 2*d*.

A double-step configuration 32*a* for the surrounding edge of the electroplating bed in the cell 32 is shown in FIG. 3. This configuration forms a more complex racheted edge for the resulting composite plate. Alternatively, the growth of the plate can be halted below the surface of the uppermost step to facilitate removal of the plate from the cell.

The plates 56 produced by the cell of FIG. 1 can be joined edge-wise at right angles as shown in FIG. 4 to form a box-like enclosure which may be further encapsulated in another material such as aluminum, if desired. The stepped edges prevent a straight seam between panels through which radiation can escape.

EXAMPLE 1

In the cell of FIG. 1 an electrolyte was used at ambient temperature containing 60 g/l of copper as copper sulfate with 75 g/l of sulfuric acid ($H_2SO_4$). The anode was an OFHC copper plate. The cathode substrate 42 was a copper screen approximately 8½ inches square, weighing about 84 grams. The current density was 10 amps per square foot, and the mesh size of the boron carbide was −170+270 cleaned. The timing of the two phases of operation in the cell of FIG. 1 was established so that preferably 80% of the boron carbide introduced the first time and 90% of subsequent carbide additions would be entrapped. The object of the experiment was to produce a thin, flexible $Cu/B_4C$ composite sheet.

The current was turned on at t=0 and 2.8 grams of boron carbide were added to the electrolyte via the funnel 36 (FIG. 1). The stirrers were operated slowly for one minute and then stopped for 19 minutes. At t=20 minutes, 2.45 grams of boron carbide were introduced into the cell by the funnel 36 and stirred for 1 minute after which the stirrer was stopped again for 19 minutes while plating continued. This sequence of one minute of stirring followed by 19 minutes of settling was repeated about 10 times over a total plating period of about four hours. In this experiment about 20 weight percent boron carbide was used resulting in about 47 volume percent with good results indicated by microphotographs in which the porocity appeared to be low and the copper appeared to surround the particles well. Similar results were obtained using a three mil copper foil for the substrate 42.

EXAMPLE 2

In another experiment, 20 weight percent boron carbide was added all at the start and the stirrers 38 were turned on for an hour and off for an hour alternately through a timer over a period of about four days. The resulting sheet or composite plate was of lesser quality having some loose boron carbide and copper particles. This experiment indicated that boron carbide should preferably be added and stirred into the electrolyte at specified intervals throughout the plating process rather than all at once.

Further experiments have indicated that good results are achieved in the verticle cells described above when the loading of boron carbide (preferably at least 20 weight percent) is kept below 50 weight percent.

A preferred technique is to add about 10% of the total weight of boron carbide at a time and stir slowly for one minute and then stop stirring to allow settling for just over an hour (e.g., 80 minutes) between the carbide additions. With any given cell the optimum stirring time can be determined experimentally as that point at which the boron carbide particles attain an acceptably uniform distribution in the electrolyte. The length of time before the next addition of boron carbide particles is the amount of time necessary for a large percentage, for example, 90% of the particles, to have been electrolytically entrapped. It may be desirable to turn off the current for a brief interval coinciding with each subsequent addition of carbide particles and agitation of the electrolyte.

Accordingly, the invention provides an improved electrolytic cell and procedure for direct codeposition of non-conductve boron carbide particles and copper by electrolytic entrapment. The cell is suited for making plates for use as side walls, end walls, end plates, and the like, in low cost, safe containers for radioactive material so that nuclear waste, in particular, may be transported, stored, and disposed of without endangering the environment.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes that come within the meaning and range of equivalency of the claims are therefore intended to be embraced therein.

I claim:

1. An apparatus for producing a composite boron carbide-filled copper layer, comprising:

a cell containing an electrolyte with copper ions;

a copper anode;

support means for positioning a substrate below said anode in contact with said electrolyte;

means for introducing electrically nonconductive particles of boron carbide into the electrolyte between said anode and a substrate, said means for introducing including an opening in the anode through which particles can be introduced into the electrolyte beneath said anode;

means for uniformly distributing particles in said electrolyte to enable particles to be evenly deposited on a substrate when a substrate is positioned beneath said anode; and means for applying plating voltage across said anode and a substrate to plate copper onto a substrate so as to entrap particles as they settle, in a growing copper matrix.

2. The apparatus as set forth in claim 1, wherein said distributing means includes a stirrer.

3. The apparatus as set forth in claim 1, wherein said cell includes means for defining a stepped edge on the composite layer which is produced when particles are entrapped by the copper plated on a substrate.

4. The apparatus as set forth in claim 3, wherein said cell includes a floor serving as the support means for a substrate and a ledge surrounding said floor.

5. The apparatus as set forth in claim 4, wherein said ledge has a square cross-section so as to form a reversibly interfitting edge on said layer.

6. The apparatus as set forth in claim 1, wherein said distributing means includes a plurality of stirrers.

7. The apparatus as set forth in claim 1, wherein said introducing means further includes a funnel received in said opening in said anode.

8. A process for producing a composite boron carbide-filled copper layer, comprising the steps of:

positioning an electrically conductive substrate below a copper anode in an electrolyte containing copper ions;

introducing a batch of loose electrically nonconductive boron carbide particles into the electrolyte beneath said anode through an opening in the anode;

agitating said electrolyte so as to disperse said particles in suspension within said electrolyte; and allowing said particles to settle onto said substrate while passing a plating current through said electrolyte between said anode and substrate such that said particles are progressively entrapped in a copper matrix growing upon the surface of said substrate.

9. The process as set forth in claim 8, wherein less than half of the total desired boron carbide for a layer of predetermined thickness is introduced at a time.

10. The process as set forth in claim 8, wherein said steps of introducing, agitating, and allowing to settle while electroplating are repeated until achieving a composite layer of predetermined thickness.

11. The process as set forth in claim 8, wherein the agitating step takes place over a substantially shorter period of time than the step of allowing to settle while electroplating.

12. The process as set forth in claim 11, wherein the duration of said step of allowing to settle while electroplating is at least ten times as long as the duration of said agitating step.

13. The process as set forth in claim 8, wherein prior to said introducing step, a layer of pure copper is electroplated on said substrate.

14. The process as set forth in claim 8, wherein after the final step of allowing to settle and electroplating, a finish coat of pure copper is electroplated over the composite layer.

15. The process as set forth in claim 14, wherein the step of electroplating the finish coat is carried out at a higher plating current than that employed during said step of allowing to settle while electroplating.

16. The process as set forth in claim 8 wherein said substrate includes copper foil.

17. The process as set forth in claim 8 wherein said substrate includes copper screen.

18. The process as set forth in claim 8 wherein said substrate includes copper plate.

19. The process as set forth in claim 8 wherein said substrate is made of stainless steel.

* * * * *